United States Patent [19]

House

[11] 4,307,483

[45] Dec. 29, 1981

[54] TRAVELING PNEUMATIC CLEANER WITH NOISE REDUCER

[75] Inventor: Thomas R. House, Charlotte, N.C.

[73] Assignee: Parks-Cramer Company, Fitchburg, Mass.

[21] Appl. No.: 160,679

[22] Filed: Aug. 18, 1980

[51] Int. Cl.[3] ..... A47L 5/38

[52] U.S. Cl. ..... 15/312 R; 15/326

[58] Field of Search ..... 15/312 R, 312 A, 326, 15/316 R

[56] References Cited

U.S. PATENT DOCUMENTS

| | | | |
|---|---|---|---|
| 3,251,175 | 5/1966 | Black | 15/312 R X |
| 3,276,065 | 10/1964 | King et al. | 15/312 A |
| 3,903,562 | 9/1975 | Miles | 15/326 X |

*Primary Examiner*—Chris K. Moore

*Attorney, Agent, or Firm*—Bell, Seltzer, Park & Gibson

[57] ABSTRACT

A noise abating enclosure is positioned beneath and movable with the overhead-mounted blower fan housing of a traveling pneumatic cleaner, and is provided with an upwardly opening air flow inlet passage in a medial portion thereof which communicates with the inlet opening in the fan housing. The enclosure also is provided with one or more stacks projecting upwardly from outer portions thereof and adjacent the fan housing so that air flows downwardly from generally above the traveling cleaner and into the stacks at locations spaced from the machines and operators below the fan housing of the traveling pneumatic cleaner so that impingement of noise generated by the air streams onto operators is minimized.

4 Claims, 4 Drawing Figures

TRAVELING PNEUMATIC CLEANER WITH NOISE REDUCER

FIELD AND BACKGROUND OF INVENTION

The cleaning of textile machines has for some time been accomplished through the use of traveling pneumatic cleaners. Such cleaners, as known to persons skilled in the arts of textile manufacturing, direct high velocity streams of air onto textile machines and textile products being processed thereon for dislodging fiber waste from the machines. Such traveling pneumatic cleaners include one or more fans arranged for travel over textile machines and a housing surrounding the fan and defining air flow passages.

Recent legislation concerning occupational safety and health has established standards concerning levels of noise in work environments and has led to efforts at controlling noise generated by textile machines. As analysis of noise to be found in a textile machine room has been undertaken, it has been discovered that operators tending textile machines may, in some instances, be exposed to impingement of noise generated by a traveling pneumatic cleaner and particularly by the fan of such a cleaner.

BRIEF DESCRIPTION OF INVENTION

With the above discussion in mind, it is an object of the present invention to minimize the impingement onto operators tending textile machines of noise generated by an overhead-track-mounted traveling pneumatic cleaner. In realizing this object of the present invention, a traveling pneumatic cleaner of the type described is provided with a noise abating enclosure so arranged as to guide air streams flowing into and through the traveling pneumatic cleaner along paths which result in reduction of the impingement of noise generated by the air streams onto operators.

Yet a further object of this invention is to release any noise generated by air streams flowing through a traveling pneumatic cleaner in a direction such as to minimize impingement of such noise directly onto operators of textile machines. In realizing this object of the present invention, air flowing into the overhead fan housing means of a traveling pneumatic cleaner is directed to flow downwardly in its course into the fan housing means and in such a manner that any noise propagated through the air stream will be propagated upwardly away from impingement directly onto textile machine operators.

Some of the objects and advantages of the invention having been stated, others will appear as the description proceeds when taken in connection with the accompanying drawings, in which FIG. 1 is an end view of a typical traveling pneumatic cleaner embodying the present invention, and showing the traveling cleaner extending over a loom representing a row of textile machines;

DETAILED DESCRIPTION

Figure 1:
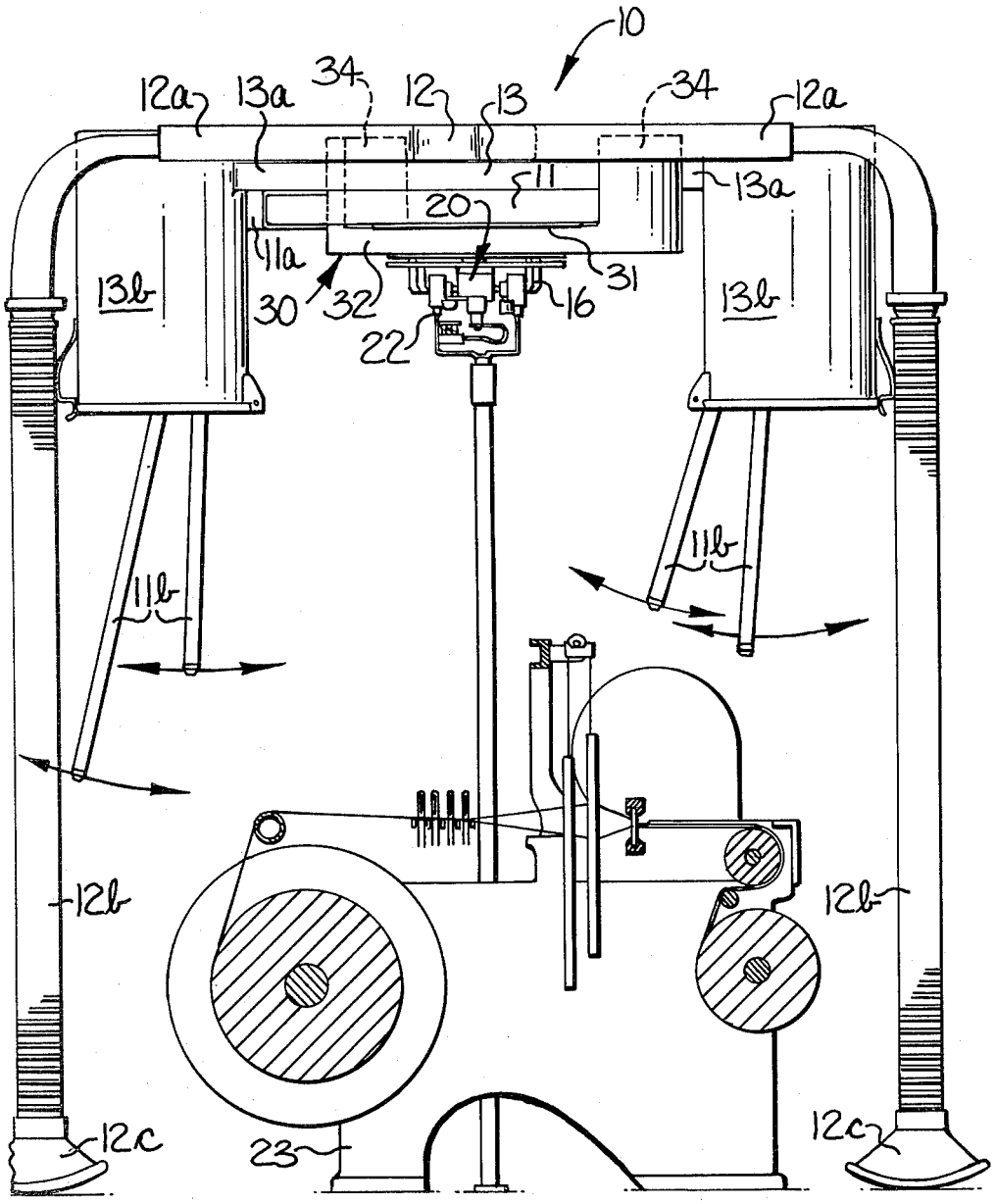

While this invention will be described hereinafter with particular reference to the accompanying drawings, in which an illustrative embodiment of the present invention is set forth, it is to be understood at the outset of the description which follows that it is contemplated that persons skilled in the applicable arts may modify the specific details to be described while continuing to use this invention. Accordingly, the description is to be understood as a broad teaching of this invention, directed to persons skilled in the applicable arts.

Referring now to the drawings, the noise reducing means of this invention is particularly useful in association with a high velocity traveling pneumatic cleaner of the general type disclosed and claimed in U.S. Pat. No. 3,304,570, issued Feb. 21, 1967 and owned in common with the present invention. By way of illustration, however, the traveling cleaner is shown in the drawings as a combination traveling, blowing and suction cleaner whose housing means and carriage means may be arranged generally as disclosed in FIGS. 19–21 of U.S. Pat. No. 3,304,571 also owned in common with the present invention.

Figure 3:
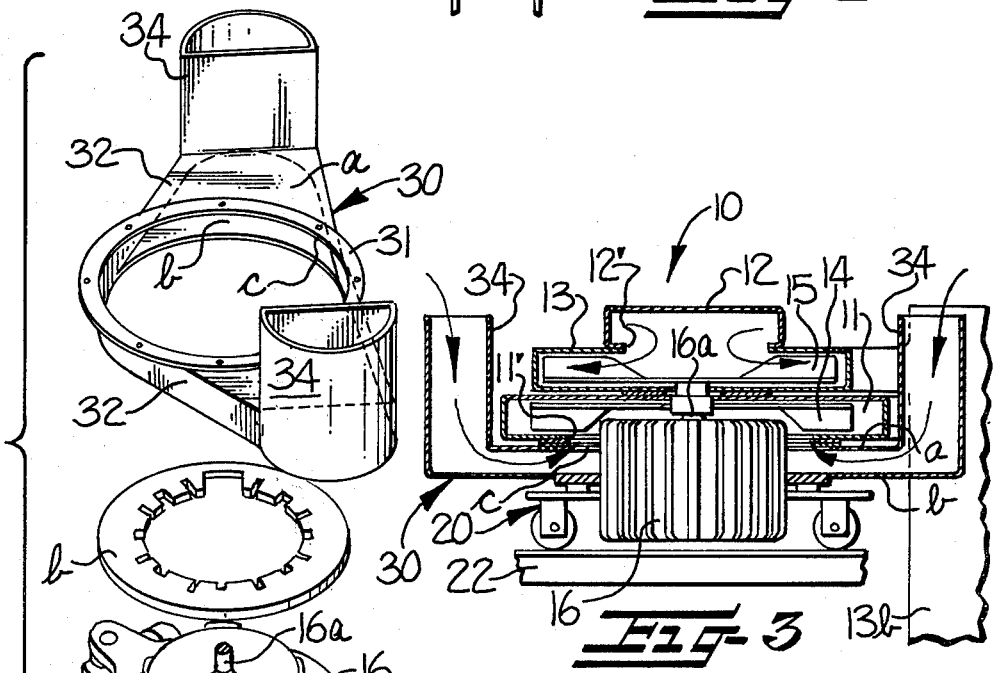
FIG. 3 is a fragmentary vertical sectional view taken substantially along line 3—3 in FIG. 2.

The traveling cleaner comprises a housing means broadly designated at 10 and including a hollow, volute blower fan housing 11 and a hollow suction housing 12 between which a hollow volute suction fan housing 13 is positioned. A central opening 12' is provided in the proximal walls of housings 12, 13 for the flow of air therethrough. As shown in FIGS. 1 and 3, the blower fan housing 11 is positioned beneath the suction housing 12 and the suction fan housing 13. The blower fan housing 11 and the suction fan housing 13 contain respective rotary air impellers or fans 14, 15 therein driven by suitable motive means shown in the form of an electric motor 16. Motor 16 extends through and below the lower wall of blower housing 11 and is mounted on a suitable wheeled carriage, broadly designated at 20, of which the motor 16 may be considered a part. The carriage 20 may be driven by any suitable means, as is well known in the art, to travel along a track 22 extending over a plurality of textile machines such as is represented by the loom 23 shown in FIG. 1.

In this instance, the fans, 14, 15 are mounted on a common vertical axis defined by the upwardly extending shaft 16*a* of electric motor 16. Suitable sealing means, not shown, may be provided between motor shaft 16*a* and the proximal walls of the blower fan housing 11 and suction fan housing 13.

Figure 2:
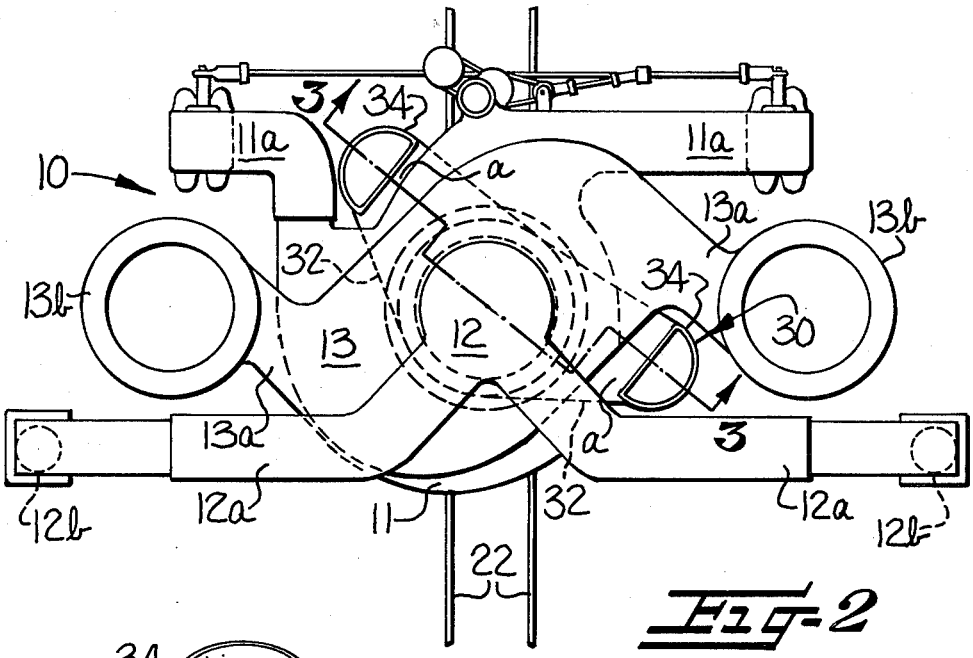
FIG. 2 is a plan view of the traveling cleaner of FIG. 1.

As shown in FIG. 2, the central portions of the blower fan housing 11 and suction fan housing 13 are relatively large in plan to accommodate the respective fans 14, 15 therein, and they have respective pairs of relatively smaller outwardly extending duct portions 11*a*, 13*a* thereon communicating therewith. Suction housing 12 also has a pair of outwardly extending duct portions 12*a* thereon and communicating therewith. The duct portions in each pair 11*a*, 12*a*, 13*a* extend laterally outwardly relative to track 22.

The upper ends of blowing tubes 11*b* of relatively small cross-section are communicatively and pivotally connected to the duct portions 11*a* of blower fan housing 11. The blowing tubes 11*b* may be of the type disclosed in said U.S. Pat. No. 3,304,570, and also may be pivotally supported and oscillated laterally on the outer portions of duct portions 11*a* in substantially the manner disclosed in the latter patent for directing streams of air of relatively high velocity onto the textile machines 23 therebelow for dislodging fiber waste from the textile machines 23 and the material in process thereon. Accordingly, the disclosure in the latter patent is incorporated herein by reference thereto and may be relied upon for a more detailed disclosure of the high velocity blowing tubes 11*b* and the operation thereof.

The outer portions of the duct portions 12*a* of the suction housing 12 also have respective dependent suction tubes 12*b* connected thereto and depending therefrom. The lower ends of the suction tubes may be provided with respective floor cleaning suction nozzles 12*c* which serve in a well known manner for picking up fiber waste from the floor of the textile room to be conveyed through the suction tubes 12*b*, the suction housing 12 and the suction fan housing 13 into one or more collection chambers on the exhaust side of the suction fan housing 13. In this instance, it will be observed in FIGS. 1 and 2 that two collection chambers 13*b* are provided which are communicatively connected to the outer ends of the substantially diametrically opposed duct portions 13*a* of the suction fan housing 13. Since the construction and purpose of the collection chambers 13*b* are well known in the art, a further disclosure thereof is deemed unnecessary.

As is well known, some noise is generated by the fan or fans of an overhead-mounted traveling cleaner, and in many instances, such noise is of such a low level as to be well within the standards established by legislative authority and to not be objectionable to attendants of the textile machines. However, in other instances the level of noise generated by the fan or fans of overhead-mounted traveling cleaners may be too loud at the level of impingement thereof upon the operators tending the textile machines to satisfy the standards established by legislative authority and might be uncomfortable or even detrimental to the health of such operators.

As is known, various traveling pneumatic cleaners have been designed to produce blowing air streams of relatively low velocity of about 2,000 to 2,800 feet per minute at about 800 to 1,200 cubic feet per minute volume, for example. However, in order to produce fine jet, very high velocity air streams emerging from the nozzles or lower ends of the tubes 11*b* of FIG. 1 at a velocity on the order of 20,000 feet per minute for securing a velocity of from about 5,000 to 10,000 feet per minute or more at the surfaces to be cleaned, as set forth in said U.S. Pat. No. 3,304,570, it can be appreciated that a relatively large volume of air must be drawn into the blower fan housing 11 through the central air inlet opening 11' provided in the bottom wall of the blower fan housing 11. It follows, therefore, that air flowing into the fan housing means of some traveling cleaners, and especially traveling cleaners of the type described above, may generate sound waves which will propagate an undesirable level of noise impinging upon textile machine operators.

Accordingly, the present invention provides means for minimizing impingement of noise onto operators tending the textile machines and comprises a noise abating enclosure, broadly designated at 30, positioned beneath and movable with the blower housing 11 and communicating with the inlet opening 11' in the fan housing 11. As will be presently described more in detail, the enclosure 30 defines at least one air flow channel underlying the blower fan housing and extending outwardly therebeneath and upwardly away from the textile machines 23 therebeneath as a tubular stack. The stack is open at its upper end so that the air flows downwardly into the stack from a direction above the textile machines and remote from the downward flow of the air streams from the tubes 11*b* onto the textile machines 23, with the stack being located in spaced relation from the machines and operators below the housing means of the traveling pneumatic cleaner so that impingement of noise generated by the air streams onto the operators is minimized.

Figure 4:
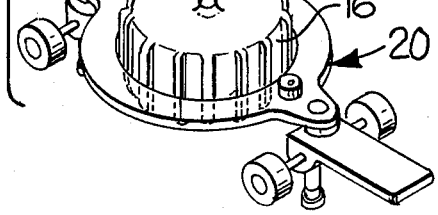
FIG. 4 is an exploded perspective view of an embodiment of the noise reducing means of the present invention disassociated from the fan housing means of the traveling cleaner, but showing how the noise reducing means may be mounted on the carriage of the traveling pneumatic cleaner.

In the illustrated embodiment of the invention, the noise abating enclosure 30 comprises a hollow body of relatively small vertical dimension and including upper and lower substantially horizontal walls a, b, and the upper wall a is provided with an upwardly directed air flow passage c in the upper medial portion thereof. As preferred, the air inlet opening 11' in the bottom wall of the blower fan housing 11 is substantially circular and of substantially greater diameter than the diameter of the upper portion of the motor 16 extending thereinto. Therefore, the upwardly directed air flow passage c in the upper wall a of the body of the noise abating enclosure 30 preferably is of a diameter complementing the air inlet opening 11' of the blower fan housing 11. The motor 16 extends through the bottom wall b of enclosure 30 in substantially air tight relation thereto, and the hollow body of the enclosure 30 is suitably secured upon the carriage 20. As shown in the upper portion of FIG. 4, the upper wall a of the enclosure 30 may be provided with an annular flange 31, defining the opening c in the upper wall a and for securing the enclosure 30 to the bottom wall of the blower fan housing 11.

As heretofore indicated, the major or central portions of the blower fan housing 11 and the suction fan housing 13 are relatively large in plan. Accordingly, the upper and lower walls a, b of the noise abating enclosure 30 define a pair of opposing, hollow wing portions 32 extending outwardly from the medial portion of the hollow body of the enclosure 30, with opposite sides of each wing portion converging outwardly from the hollow body medial portion and having respective stacks 34 projecting upwardly from the smaller outer end portions of the opposing wing portions 32 of the enclosure 30.

As best shown in FIG. 3, the lower ends of the upwardly directed tubular stacks 34 are in open communication with the substantially diametrically opposed outer portions of the wing portions 32 of the enclosure 30. The stacks 34 extend upwardly from the noise abating enclosure and have open upper ends which are preferably located above the level of the suction fan housing 13 so that air flows downwardly into the stacks 34 from areas remote from the textile machines and remote from the downward flow of the air streams from the high velocity blowing tubes 11*b* being directed onto the textile machines.

Thus, the air enters the stacks 34 at locations spaced from the machines and the operators and well above the operators as the air is flowing into the noise abating enclosure 30 in its course along the air flow channel defined between the upper and lower walls a, b of the enclosure 30 and into the blower fan housing 11. Tests have shown that the loudness of the noise propagated by traveling cleaners of the type described equipped with the noise reducing means of this invention was reduced by up to about six decibels at the level of the heads of the operators therebelow as compared to the loudness of the noise propagated by similar traveling cleaners which were not equipped with the noise reducing means of this invention. Thus, it can be seen that air flowing into the blowing fan housing of the traveling pneumatic cleaner is directed to flow in such a manner that any noise propagated through the air stream will largely be propagated upwardly and away from impingement directly onto textile machine operators. While the downward direction of air flow illustrated in the drawings is vertical, it is contemplated that noise abatement will be achieved where the downward direction is also angular such as where the stacks 34 are inclined or have inclined portions for reducing clearance heights.

In the drawings and specification there has been set forth a preferred embodiment of the invention and, although specific terms are employed, they are iused in a generic and descriptive sense only and not for purposes of limitation.

That which is claimed is:

1. In a traveling pneumatic cleaner for directing high velocity streams of air from above textile machines downwardly onto the textile machines and textile products being processed thereon for dislodging fiber waste therefrom, and which includes a fan arranged for travel along a predetermined path over the machines to be cleaned, and a housing surrounding the fan and having depending air discharge nozzles from which streams of air impelled by the fan are discharged onto machines therebelow, the fan housing also having a central air inlet opening therein through which air is drawn by the fan, the combination therewith of means for minimizing impingement of noise onto operators tending the textile machines and comprising an enclosure positioned beneath and movable with the housing and having an upwardly opening air flow inlet passage in a medial portion thereof communicating with the inlet opening in the fan housing, said enclosure defining at least one air flow channel underlying the housing and extending outwardly therebeneath and upwardly away from the textile machines as a tubular stack, said stack having an open upper end so that air flows downwardly from generally above the traveling pneumatic cleaner and into the stack at a location spaced from the machines and operators below the fan housing of the traveling pneumatic cleaner whereby impingement of noise generated by the air streams onto operators is minimized.

2. An apparatus according to claim 1 wherein the traveling pneumatic cleaner further comprises a suction fan housing positioned above the first-named fan housing and having a suction fan positioned therein with the suction fan housing having at least one depending suction tube thereon open at its lower portion for drawing lint and other fiber waste thereinto and thus into the suction fan housing, and wherein said tubular stack extends upwardly adjacent and outwardly of the suction fan housing.

3. In a traveling pneumatic cleaner for directing jets of relatively high velocity air from above textile machines onto the machines and textile products being produced thereon, and which includes a high velocity blower fan mounted for travel in a predetermined path over the machines to be cleaned, a blower fan housing surrounding the fan and having depending air discharge nozzles thereon from which air from the fan is discharged onto the machines therebelow, and the bottom of the fan housing also having an air inlet opening therein through which air is drawn by the fan, the combination therewith of means for reducing the noise propagated by air entering the blower fan housing and comprising a noise reducing enclosure positioned beneath and mounted to travel with the blower fan housing and having an upwardly directed air flow passage in a medial portion thereof communicatively aligned with the inlet opening in the bottom of the blower fan housing, said enclosure defining an air flow channel extending outwardly beneath the blower fan housing and communicating with said upwardly directed air flow passage, and a pair of upwardly directed tubular stacks positioned on respective outer portions of said enclosure in substantially diametrically opposed relation thereto, said stacks being open at their upper ends so that air flows downwardly from generally above the traveling pneumatic cleaner and into the stacks at locations spaced from the machines and the operators below the fan housing of the traveling pneumatic cleaner as the air enters the enclosure in its course into the blower fan housing whereby impingement of noise generated by the air being directed into the fan housing is minimized.

4. Apparatus according to claim 3 wherein the air inlet opening in the bottom of the blower fan housing is substantially circular and of relatively large diameter, and wherein said noise abating enclosure comprises a hollow body of relatively small vertical dimension and having lower and upper walls, said upwardly directed air flow passage being formed in said upper wall in a medial portion of said hollow body and being of a diameter complementing the air inlet opening of the blower fan housing, said hollow body including a pair of opposing, hollow, wing portions extending outwardly from said medial portion of said hollow body, with opposite sides of each wing portion converging outwardly from said hollow body medial portion and having smaller outer ends thereon, and wherein said stacks project upwardly from said smaller outer ends of said opposing wing portions of said hollow body.

* * * * *

UNITED STATES PATENT AND TRADEMARK OFFICE

CERTIFICATE OF CORRECTION

PATENT NO. : 4,307,483

DATED : Dec. 29, 1981

INVENTOR(S) : Thomas R. House

It is certified that error appears in the above-identified patent and that said Letters Patent are hereby corrected as shown below:

On the face of the patent, Line [22] "Aug. 18, 1980" should be --June 18, 1980--

Signed and Sealed this

*Twenty-second* Day of *June 1982*

[SEAL]

*Attest:*

GERALD J. MOSSINGHOFF

*Attesting Officer*

*Commissioner of Patents and Trademarks*